US007273097B2

(12) United States Patent
Fox et al.

(10) Patent No.: US 7,273,097 B2
(45) Date of Patent: Sep. 25, 2007

(54) FORMATION CHARACTERIZATION USING WELLBORE LOGGING DATA

(75) Inventors: Philip Edmund Fox, Covington, LA (US); Gary James Frisch, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 10/842,386

(22) Filed: May 10, 2004

(65) Prior Publication Data

US 2004/0256101 A1 Dec. 23, 2004

Related U.S. Application Data

(60) Provisional application No. 60/469,526, filed on May 9, 2003.

(51) Int. Cl.
*E21B 47/00* (2006.01)

(52) U.S. Cl. ..... 166/250.02; 166/254.2; 702/11

(58) Field of Classification Search ..... 166/250.02, 166/254.1, 254.2, 255.1, 249; 33/302, 303; 367/35; 73/152.57, 152.58, 152.59, 152.16; 181/105; 702/11
See application file for complete search history.

(56) References Cited

U.S. PATENT DOCUMENTS 3,580,334 A * 5/1971 Broussard et al. ..... 73/152.57
5,491,668 A * 2/1996 Priest ..... 367/35
5,699,246 A * 12/1997 Plasek et al. ..... 702/11
5,705,812 A 1/1998 Brewer et al. ..... 250/264
5,737,277 A * 4/1998 Priest ..... 702/11
5,753,813 A * 5/1998 Hagiwara ..... 166/254.2

OTHER PUBLICATIONS

SPE71399; *Advanced Ultrasonic Scanning Tool and Evaluation Methods Improve and Standardize Casing Inspection*; G. Frisch and B. Mandal; Sep. 30-Oct. 3, 2001; (pp. 1-15).

Arne de Kock, et al; *GOM Offshore Subsidence Monitoring Project with a New Formation Compaction Monitoring Tool*;; (Undated); (pp. 1-7).

* cited by examiner

*Primary Examiner*—Lanna Mai
*Assistant Examiner*—Matthew J. Smith
(74) *Attorney, Agent, or Firm*—Conley Rose, P.C.

(57) ABSTRACT

Methods for determining formation characteristics comprising establishing baseline casing conditions for a string of casing disposed within a wellbore in a formation and measuring updated casing conditions for the string of casing at a first time interval from the establishing of the baseline casing conditions. The baseline casing conditions are compared to the updated casing conditions to determine changes in the string of casing over the first time interval. These changes in the string of casing are then used to determine formation characteristics.

26 Claims, 8 Drawing Sheets

FORMATION CHARACTERIZATION USING WELLBORE LOGGING DATA

CROSS-REFERENCE TO RELATED APPLICATIONS

This application claims priority to U.S. Provisional Patent Application 60/469,526, filed May 9, 2003, and entitled "Formation Characterization using Wellbore Logging Data," which is hereby incorporated by reference herein for all the purposes.

STATEMENT REGARDING FEDERALLY SPONSORED RESEARCH OR DEVELOPMENT

Not applicable.

BACKGROUND OF THE INVENTION

The embodiments of the present invention relate generally to methods for characterizing a subterranean formation surrounding a wellbore. More specifically, the embodiments relate to methods for characterizing the formation using data obtained from wellbore logging.

Fluids stored in subterranean formations are contained, often at elevated pressures, within pores found within the formation rock. The removal of these fluids from subterranean formations during the production of hydrocarbons, native water, injected fluids, or steam results in a decrease of pore pressure within the formation. This decreased pore pressure leads to a lowering of mechanical support provided to the rock system and can result in closer packing of formation particles or in some cases the movement and/or removal of formation particles by the production processes.

If the formation loses enough mechanical support, portions of the formation yield and break. This is known as formation compaction. When formation compaction occurs, the portion of a wellbore through the compacted formation can be affected. Thus, it is often desirable to monitor the compaction within a producing formation and control the production processes to limit damage to the formation or wellbore. Additional value in monitoring formation compaction may be derived by providing additional wellbore lifetime and providing a prediction of the time for which a wellbore will be mechanically able to support commercial or scientific activities.

One method currently used to monitor formation compaction involves placing marker tags, normally consisting of a radioactive material, onto the casing at known intervals. These tags are typically placed on the casing before it is run into the well or into the formation before or after running the casing into the wellbore. In some applications, marker tags may be installed into an existing casing already in place in the wellbore. The intervals between the marker tags can then be monitored by sensors, such as gamma ray detectors, run into the wellbore on a downhole tool. This process is discussed in "GOM Offshore Subsidence Monitoring Project with a New Formation Compaction Monitoring Tool"; Ame de Kock, Shell Offshore Inc. New Orleans, La.; T. Johnson, Halliburton Energy Services, New Orleans, La.; T. Hagiwara, H. Zea, F. Santa Halliburton Energy Services, Houston, Tex., which is hereby incorporated by reference herein for all purposes. Although providing a direct measurement of casing deformation, which is related to and caused by formation compaction, many wells do not have the marker tags required to perform the measurement. Additionally, because the use of radioactive materials is heavily regulated, non-radioactive solutions are desirable.

It is known that formation compaction can cause damage to the casing contained within the wellbore. As formation compaction occurs, the casing is compressed. This compression can lead to changes in the casing's diameter, thickness, and roundness as well as cause large diameter bends in the casing. In extreme cases, the casing fails, thus disrupting production from the well. Thus, it is desirable to monitor casing mechanical deformation and formation compaction in order to provide early detection of formation compaction problems, allowing the reservoir management procedures to be changed accordingly. Well lifetime mechanical conditions and dynamic predictions allow optimized strategic planning for the existing well and also the best planning for replacement wells as needed.

The collection of downhole information, also referred to as logging, is realized in different ways. Logging is used to measure many different properties of the casing, wellbore, and surrounding formation. Tools to measure wellbore properties may employ techniques involving electromagnetic signals, ultrasonic signals, refracted or flexural sonic signals, nuclear radiation sources, and mechanical measurements. For example, ultrasonic imaging acquisition has been used to help determine the deformation of the well casing by transmitting ultrasonic signals into the well and analyzing their reflections. Through this ultrasonic measurement information about the wellbore, casing, cement, and formation can be determined. Techniques for using ultrasonic data to compute borehole geometry are disclosed in U.S. Pat. No. 5,638,337 and U.S. Pat. No. 5,737,277, both of which are incorporated by reference herein for all purposes.

It is also known in the art to mechanically measure the diameter, also known as the caliper, of a borehole to correct formation measurements that are sensitive to size or standoff. These corrections are necessary for accurate formation evaluation. One technique for measuring the caliper incorporates a mechanical apparatus with extending contact arms that are forced against the wall of the borehole.

Thus, there remains a need in the art for methods of characterizing a subterranean formation using data acquired during well logging activities. Therefore, the embodiments of the present invention are directed to methods, of correlating well logging data into useful data for evaluating and characterizing the formation, that seek to overcome the limitations of the prior art.

SUMMARY OF THE PREFERRED EMBODIMENTS

Methods for determining formation characteristics comprising establishing baseline casing conditions for a string of casing disposed within a wellbore in a formation and measuring updated casing conditions for the string of casing at a first time interval from the establishing of the baseline casing conditions. The baseline casing conditions are compared to the updated casing conditions to determine changes in the string of casing over the first time interval. These changes in the string of casing are then used to determine formation characteristics.

In one embodiment the baseline and updated casing conditions comprise geometric data taken from a plurality of depths within the string of casing. The geometric data may comprise one or more of radius, diameter, thickness, and eccentricity at a single depth within the string of casing. The formation characteristics may comprise one or more of compaction, strain, failure prediction, and permeability. In some embodiments, the method further comprises adjusting reservoir management in response to the determined formation characteristics. In certain embodiments, the casing conditions are measured by acquiring ultrasonic data including two-way travel time and amplitude of first arrival of an ultrasonic signal.

In another embodiment, a method for determining formation compaction comprises disposing an ultrasonic tool within a cased wellbore disposed within a formation and performing an ultrasonic evaluation of the casing at a plurality of depths within the wellbore. The ultrasonic evaluation produces an ultrasonic waveform response that is used to determine geometric properties of the casing. The geometric properties of the casing are used to determine formation compaction. In certain embodiments, the geometric properties of the casing can be used to determine formation strain and casing compaction, which may be related to formation permeability and used to predict failure of the wellbore.

In other embodiments, a method for determining formation compaction comprises establishing baseline values for a property of a casing string disposed within a wellbore drilled in a formation. The baseline values are determined at a plurality of depths in the wellbore. The method also comprises determining updated values for the geometric property at a plurality of depths in the wellbore and comparing the updated values to the baseline values to determine changes in the one or more geometric properties. Formation compaction can then be determined based on an established correlation between formation compaction and changes in the geometric property. In certain embodiments, the correlation is established by comparing compaction logs to geometric properties of a portion of a cased wellbore that has markers locatable by a compaction logging tool.

In one embodiment, a method allows identification and measurement of the well casing properties that have been induced from earth formation movements, commonly termed formation compaction. Additionally mechanical characteristics of the well casing can be characterized to form an independent measurement and characterized response to determine earth formation compaction from the measurements without the need for radioactive, or other marker tags, on the casing or within the earth formation. By using the measured tool responses and determining the mechanical deformation of the well casing, a continuous analysis can be performed in-situ in the wellbore to determine the extent and magnitude of formation compaction throughout the wellbore. Due to the individuality of the data acquisition and derived analysis, this method can be applied in any wellbore that has accessibility for the measuring device and an environment suitable for the measurements themselves.

Thus, the present invention comprises a combination of features and advantages that enable it to provide formation characterization data from wellbore logging data. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
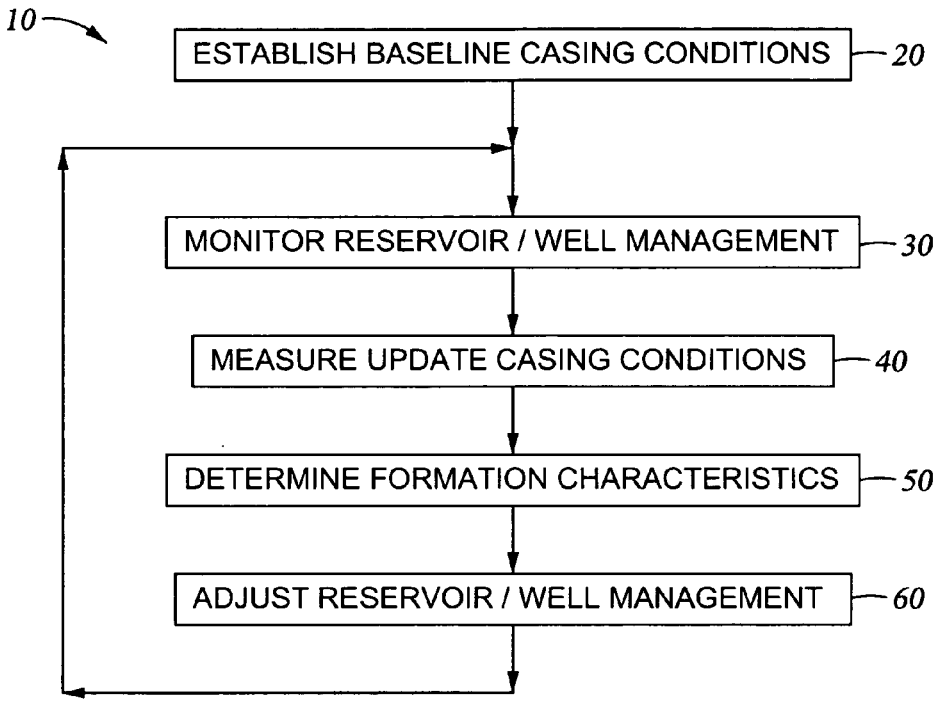
FIG. 1 is a flowchart representing a method for determining formation characteristics in accordance with embodiments the present invention.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

Referring now to FIG. 1, a method 10 for determining formation characteristics comprising establishing baseline casing conditions 20, monitoring reservoir/well management 30, measuring updated casing conditions 40, determining formation characteristics 50, and adjusting reservoir/well management 60. In method 10, measured casing conditions 40 are compared to baseline casing conditions 20 to identify changes in the conditions of the casing. These changes in casing conditions can be used to determine formation characteristics 50 that can be used to adjust reservoir or well management 60 to maximize production from-a particular well or group of wells.

In some embodiments, the method may rely on a study well that is fitted with casing markers, or other type of pre-installed compaction determination apparatus, that serves as a reference in determining the relationships between casing conditions and formation characteristics. Because this study well would be located in the same formation and have a similar construction the relationships observed in the study well could be correlated to other wells in the same field. Similarly, within one particular well, measurements and relationships determined in one particular section of the well may be used as a reference in analyzing other portions of the same well.

One important aspect to method 10 is identifying a correlation between changes in casing conditions and certain formation characteristics that cause stress and deformation in the casing. For example, formation compaction can cause changes in the diameter of the casing in the region of compaction. Because the stresses created in the casing can cause measurable changes in the casing itself, embodiments of the present invention seek to characterize and evaluate formation characteristics using casing and other wellbore evaluation logging tools currently being used. The preferred embodiments can also be utilized in existing wellbores that do not have historical data or existing monitoring systems, such as casing mounted radioactive tags.

The measured mechanical properties of the casing might be acquired at a time when some of the deformations may have taken place prior to the first measurement in the well. In other words, a baseline may typically be established at the time the casing is placed in the well, but a baseline may also reference a time weeks, months or years after placement of casing in the well. Whether method 10 is utilized in a newly cased well or in an existing well, the initial step of establishing baseline casing conditions 20 is important. These baseline conditions may be established at any point during the life of the well, whether at initial construction or at some point mid-life of the well.

Figure 2:
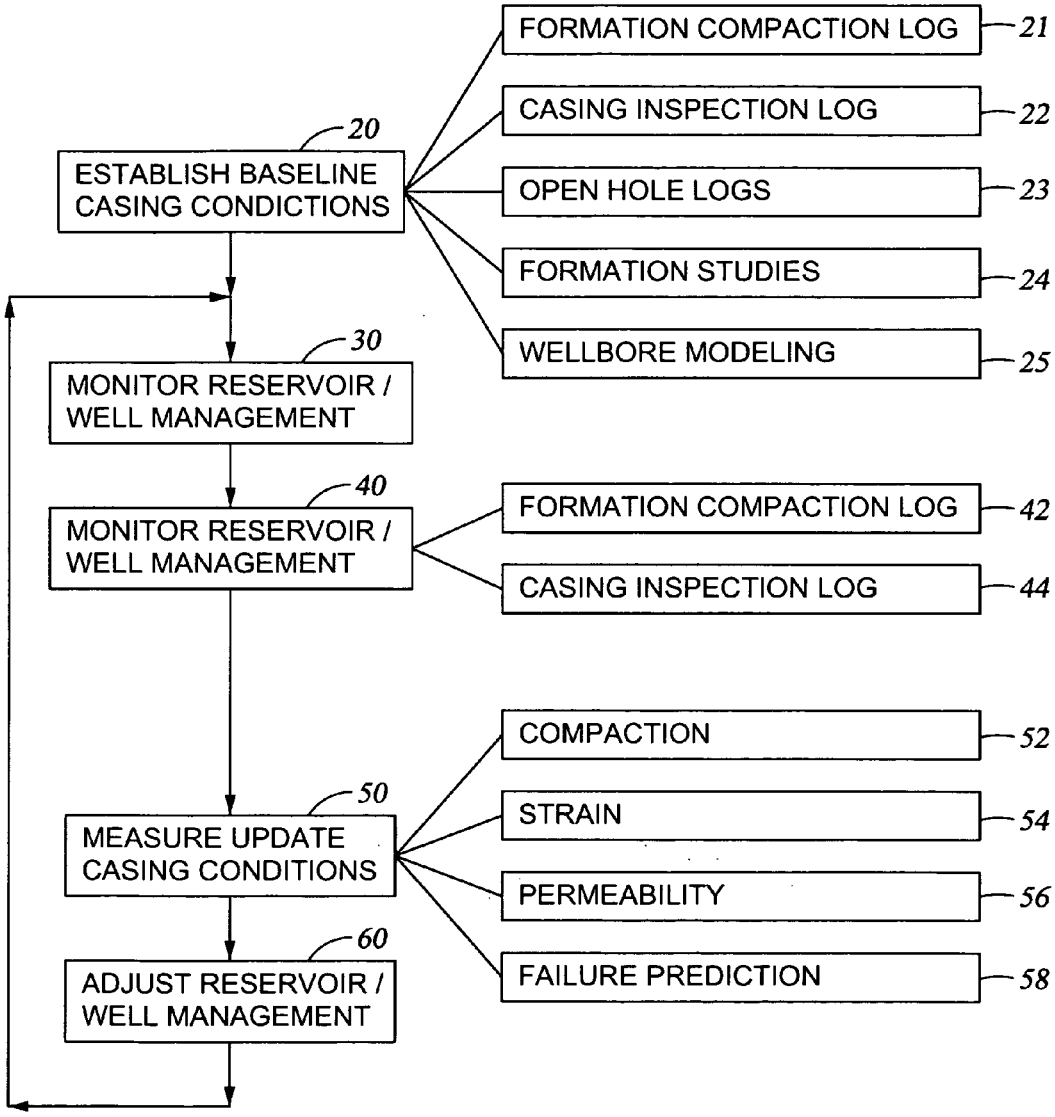
FIG. 2 is a flowchart representing a method for determining formation characteristics in accordance with embodiments the present invention.

Referring now to FIG. 2, baseline conditions 20 may be established by any one or combination of methods including, but not limited to, formation compaction logs 21, casing inspection logs 22, open hole logs 23, formation/reservoir studies 24, and wellbore modeling 25. The measurement of casing conditions may be continuous over the entire well or acquired across selected depth intervals within the well. In some embodiments, stationary measurements can also be taken at specific depths within the well.

Formation compaction logs 21 may be taken by a tool that tracks the position of radioactive tags that are mounted to the casing. One such tool is the Formation Compaction Monitoring Tool (FCMT) produced by Halliburton. The radioactive tags are generally installed at selected intervals on the outside of the casing as it is installed in the wellbore. The tags are often installed at about ten foot intervals but may be installed at greater or lesser intervals as desired. In many wells only a portion of the casing has radioactive tags installed. As a tool is lowered into the wellbore, it senses the radioactivity of the tags to determine the vertical spacing between tags. Compaction may be indicated where the vertical distance between tags changes over a period of time.

Casing inspection logs 22 seek to determine a profile of casing conditions, including such data as radius, diameter, eccentricity, wall thickness, and cement evaluation. In one embodiment, a circumferential acoustic scanning tool can be used in both an imaging and cased hole mode to evaluate the casing. One tool suitable for this type of evaluation is the ultrasonic CAST-V™ tool, manufactured by Halliburton. Alternate embodiments may include providing for combined high resolution imaging simultaneously with interior caliper and casing wall thickness data acquisition using, in part or in whole, electromagnetic, ultrasonic, refracted sonic, flexural sonic, nuclear and mechanical measurements and characterized responses.

Other types of tools that may be used to collect casing or wellbore data include, but are not limited to, refracted sonic tools (CBL—cement bond), flexural and refracted sonic tools (WaveSonic), pulse echo array ultrasonic tools (PET), flux and eddy current tools (PIT), phase thickness tools (METG), pulsed neutron/elemental yield tools (RMT-E, PSGT, and TMD-L), rotating gamma ray tools (Rota Scan), rotating spectral gamma ray tools (Rota Scan-S), and multi-armed mechanical calipers (MIT). Additional existing and/or future developed measurement systems and associated relationships derived from the measured data may be used to understand changes in the earth environment around the well.

Another method for establishing baseline casing conditions 20 is using open hole logs 23 that are taken before the casing is installed in the wellbore. Open hole logs 23 and formation studies 24 can be used to identify areas of expected compaction, provide studies of permeability, rock strength, and fluid saturation in various strata of the formation. Both open hole logs 23 and formation studies 24 may prove useful in wellbore modeling 25 to establish baseline casing conditions 20. Wellbore modeling 25 may include using a pre-installation geometric profile of the casing in conjunction with expected wellbore stresses to predict baseline casing conditions 20. The wellbore stresses may include hydrostatic effects, confining stress effects, thermal effects, and installation forces, all of which may change the geometric profile of the casing.

Once baseline casing conditions 20 have been established, the well is normally produced for a certain amount of time. During this production phase, it may be helpful to monitor reservoir or well management processes in order to track the types of stresses that the wellbore may be incurring. For example, it may be desired to monitor the rates, volumes, and pressures of fluids produced from, or injected into, the well or reservoir. These and other activities both on a certain well and within the reservoir, field, layer, or zone may also have effects on casing stress and may be useful to monitor.

Once it becomes desirable to evaluate the condition of the producing well, updated casing conditions 40 can be measured. If the well has radioactive tags (or other compaction indicators), formation compaction log 42 can be run to provide a direct determination of compaction. In other regions of the well, as well as wells not having radioactive tags, inspection log 44 can be performed to provide an updated profile of casing conditions. Inspection log 44 is also preferably run in the regions equipped with radioactive tags in order to help establish a correlation between the compaction and changes in the casing conditions. As with inspection log 22 that may be used to establish baseline casing conditions 20, inspection log 44 seeks to determine a profile of casing conditions, including such data as diameter, eccentricity, wall thickness, and cement evaluation by any of a variety of inspection techniques.

Once updated casing conditions 40 have been established, any changes between the baseline casing conditions 20 and the updated casing conditions 40 can be identified. These changes in casing conditions can indicate one or more formation characteristics 50. Among the formation characteristics that can be determined, or inferred directly, are compaction 52, strain 54, and permeability 56. These conditions, as well as casing conditions, can be used to evaluate the wellbore for failure prediction 58.

Formation characteristics 50 can then be used by an operator to adjust the reservoir and/or well management process 60 to optimize production from the well or a group of wells. For example, an operator can take remedial action to extend the life of a well or plan for sidetrack wells or other intervention. After another period of production 30, additional updated casing conditions 40 can be measured and analyzed to determine new formation characteristics 50.

Figure 3:
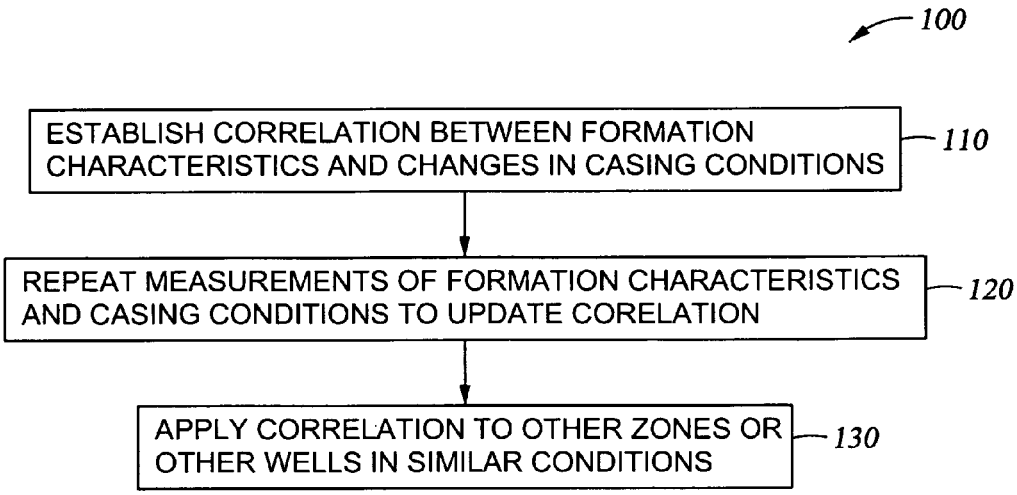
FIG. 3 is a flowchart representing a correlation method in accordance with embodiments of the present invention.

Referring now to FIG. 3, one method 100 correlating a formation characteristic to changes in casing conditions is shown. The first step 110 is establishing a correlation between a formation characteristic and a change in casing conditions. This can be achieved by comparing known casing conditions to known formation characteristics in a certain section of a wellbore. For example, in a section of casing equipped with radioactive tags, a compaction log can be compared to an inspection log to correlate changes in casing radius or thickness to formation compaction. Once an initial correlation is established, a second step 120 can be performed wherein the measurements of formation characteristics and can be repeated and the correlation updated as necessary. The correlation can then be applied 130 to sections of the same well that do not have radioactive tags and to other wells in the same or similar formations. Therefore, a determination of formation compaction can be achieved without sole reliance on radioactive tags being installed on the casing in the specific area of interest. Method 100 can also be applied to other formation characteristics that correlate to casing conditions, such as strain and permeability.

Figure 4:
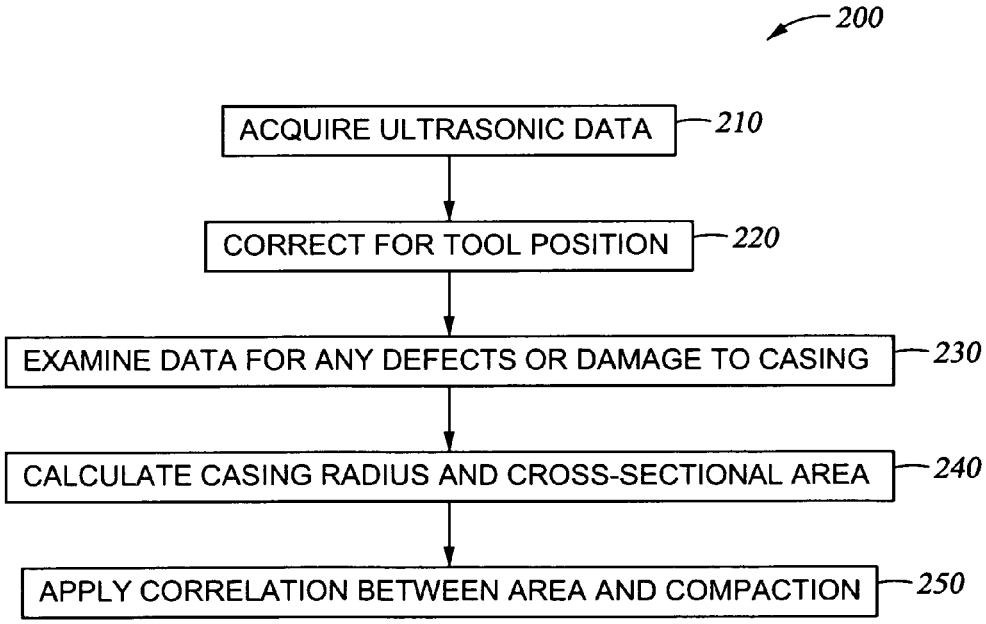
FIG. 4 is a flowchart representing an ultrasonic evaluation of casing conditions in accordance with embodiments of the present invention.

Referring now to FIG. 4, a method 200 for determining formation compaction from an ultrasonic casing evaluation is shown and includes acquiring ultrasonic data 210, correcting the data for tool position 220, examining the data for casing defects or damage 230, calculating a casing radius and cross-sectional area 240, and applying a correlation between area and compaction 250. Acquiring ultrasonic data 210 may be achieved by a circumferential acoustic scanning tool, such as the ultrasonic CAST-V™, that utilizes a single rotating transducer that makes a plurality of acoustic measurements around the wellbore. Also the PET™, which used multiple transducers disposed about a circumference of the tool.

Ultrasonic signals are transmitted from the tool and reflect off of the casing and surrounding formation. The received ultrasonic signals provide an ultrasonic waveform response that can be analyzed to provide geometrical information about the casing and cement. For example, the two-way travel time of the ultrasonic signals indicates the distance from the tool to the inside of the casing and the frequency of the response and amplitude of first arrival can be used to determine the thickness of the casing and the strain in the casing wall. The ultrasonic tool can also be used to evaluate the casing-cement interface and provide for an evaluation of the cement.

Once the ultrasonic data is acquired, it is then corrected for tool position 220. Because the tool is not necessarily centered within the casing, the received signals are evaluated and corrected for the position of the tool in the casing. One method of correcting for tool position the Society of Petroleum Engineers (SPE) Paper #71399, entitled "Advanced Ultrasonic Scanning Tool and Evaluation Methods Improve and Standardize Casing Inspection," by G. Frisch, SPE, and B. Mandal, SPE, Halliburton Energy Services, which is hereby incorporated by reference herein for all purposes.

In the method described therein, the transit time or to and from the casing is obtained for at least five separate ultrasonic signals using a rotational ultrasonic transducer. The circumferential distances between the tool center and the borehole wall are calculated using the fluid travel velocity and unwanted distance measurements that are far from the average are discarded. A least square fit is then used to determine five co-coefficients ($a_o$, $b_o$, $c_o$, $d_o$, and $e_o$) and a best-fit ellipse Q (ϕ), where the equation of the ellipse is as follows.

$$\frac{((r\cos(\phi)-X)\cos(\theta)+(r\sin(\phi)-Y)\sin(\theta))^2}{a^2}+\frac{(-(r\cos(\phi)-X)\sin(\theta)+(r\sin(\phi)-Y)\cos(\theta))^2}{b^2}=1 \quad \text{Eq. 1}$$

This equation may be simplified to express it in terms of the five unknowns ($a_o$, $b_o$, $c_o$, $d_o$, and $e_o$) and as a quadratic of r:

$$r^2+\cos(\phi)^2+r^2a_o\sin(\phi)^2+r^2b_o\sin(2\phi)+rc_o\cos(\phi)+rd_o\sin(\phi)+e_o=0 \quad \text{Eq. 2}$$

Where, $$a_o=\frac{b^2\sin(\theta)^2+a^2\cos(\theta)^2}{b^2\cos(\theta)^2+a^2\sin(\theta)^2} \quad \text{Eq. 3}$$

$$b_o=\frac{(b^2-a^2)\sin(\theta)\cos(\theta)}{b^2\cos(\theta)^2+a^2\sin(\theta)^2} \quad \text{Eq. 4}$$

$$c_o=2\left[\frac{b^2[X\cos(\theta)+Y\sin(\theta)]\cos(\theta)+a^2[X\sin(\theta)-Y\cos(\theta)]\sin(\theta)}{b^2\cos(\theta)^2+a^2\sin(\theta)^2}\right] \quad \text{Eq. 5}$$

$$d_o=2\left[\frac{b^2[X\cos(\theta)+Y\sin(\theta)]\sin(\theta)-a^2[X\sin(\theta)-Y\cos(\theta)]\cos(\theta)}{b^2\cos(\theta)^2+a^2\sin(\theta)^2}\right] \quad \text{Eq. 6}$$

$$e_o=\left[\frac{b^2[X\cos(\theta)+Y\sin(\theta)]^2+a^2[X\sin(\theta)-Y\cos(\theta)]^2-a^2b^2}{b^2\cos(\theta)^2+a^2\sin(\theta)^2}\right] \quad \text{Eq. 7}$$

The orientation of the hole ellipse (θ) may determined based on Q (ϕ) by finding the angle at which major axis is at a maximum. Using the major axis direction (θ) and at ϕ=θ, Q (ϕ)−Q (ϕ+π) represents the length of major axis and at ϕ=θ+π/2: Q (ϕ)−Q (θ+π) refers the length of minor axis. Using major axis location and the lengths will determine the hole center (X, Y). From the hole center location, actual transit time can be calculated to correct tool eccentricity.

Once corrected for tool position, the signals can then be examined 230 to identify any defects or damage to the casing and to make sure the data is within acceptable ranges. Anomalies or erroneous data can then be eliminated before the casing average radius and cross-sectional area are calculated 240. An established correlation can then be applied 250 to the cross-sectional area to identify zones of formation compaction. Method 200 can also be applied to other formation characteristics that correlate to casing conditions, such as strain and permeability, and can use other measured casing conditions, such as radius, eccentricity, and thickness.

Figure 5:
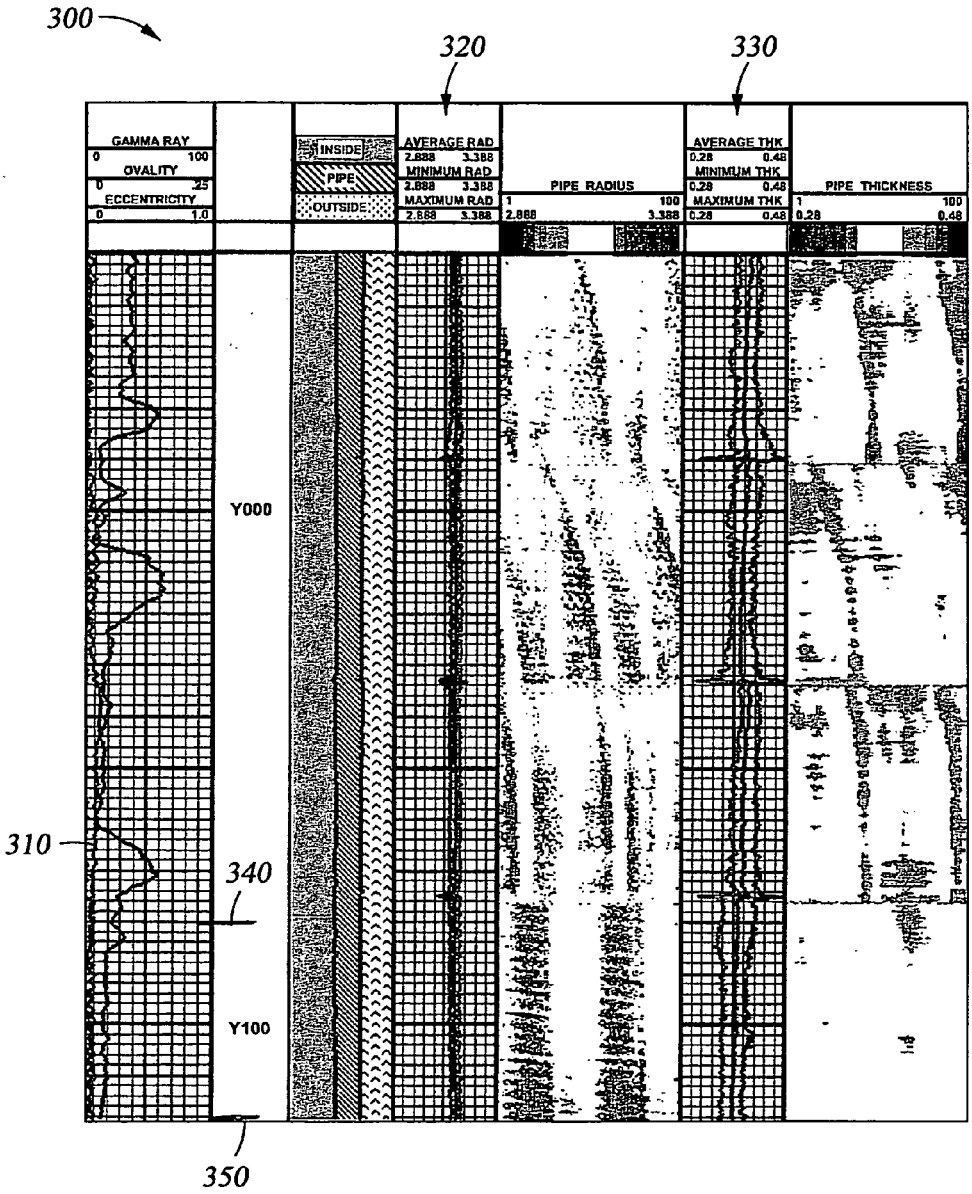
FIG. 5 is a casing evaluation log performed in accordance with embodiments of the present invention.

Referring now to FIG. 5, a casing evaluation log 300 compiled from data acquired by an acoustic tool is shown. Log 300 includes a correction for eccentricity 310 of the tool and calculations of pipe radius 320 and pipe wall thickness 330. The areas of increased radius and increased thickness above 340 are probably due to casing manufacturing defects. From 340 to 350 could be indicative of compaction due to an increase in the radius of the casing.

Referring now to FIGS. 6–9, several correlations between casing conditions and formation characteristics are shown. These correlations were established with data taken from an existing well and may not be constant in other wells but provide an example of correlations between casing conditions and formation characteristics.

Figure 6:
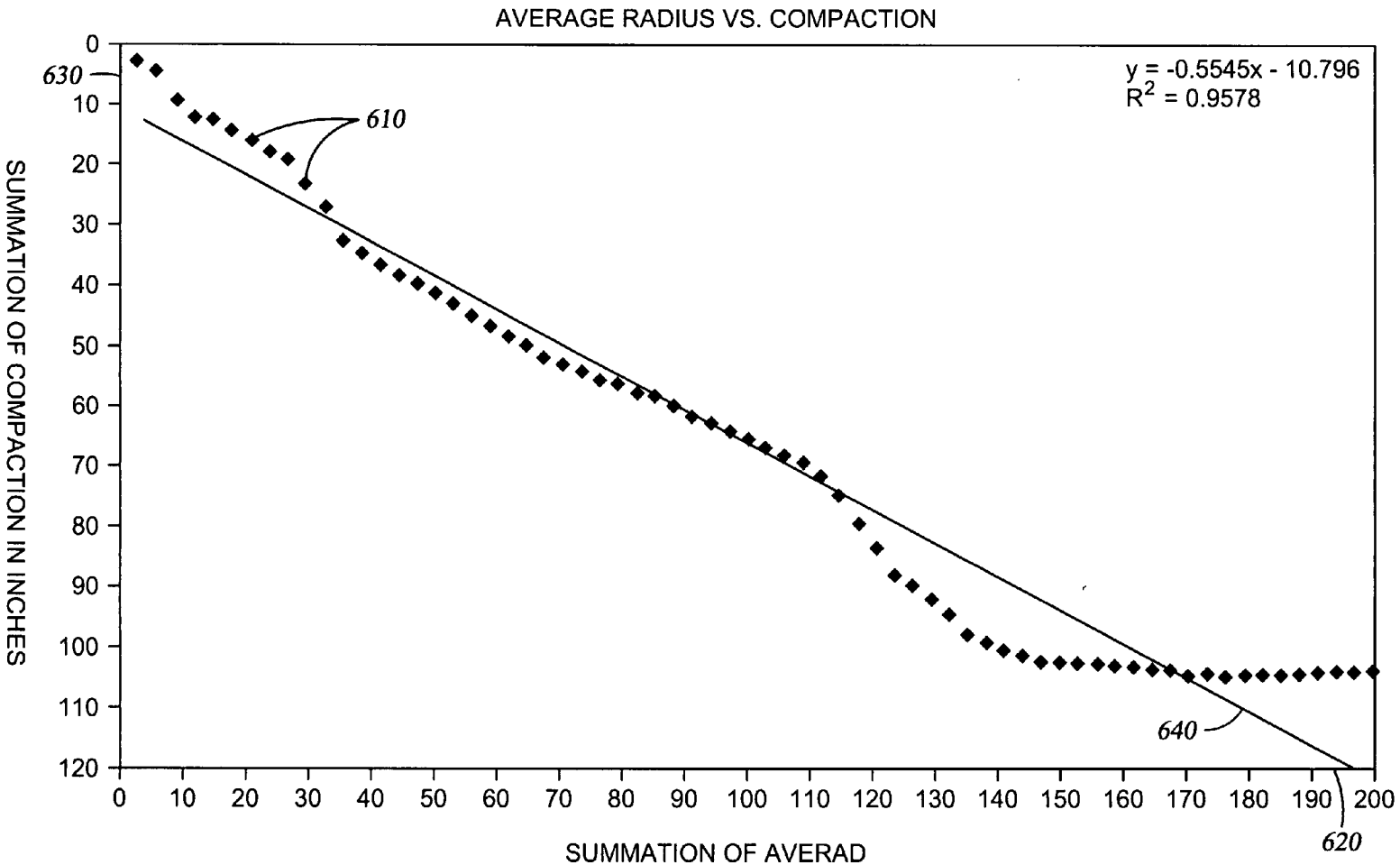
FIG. 6 is a graphical representation of the relationship of average radius and compaction.

FIG. 6 illustrates the relationship between average radius of the casing and compaction within the formation. Data points 610 mark individual relationships between average radius 620 and compaction 630, where the average radius and compaction are summated along the depth of the well. Curve 640 illustrates a generally linear relationship between average radius and compaction through a large portion of the wellbore.

Figure 7:
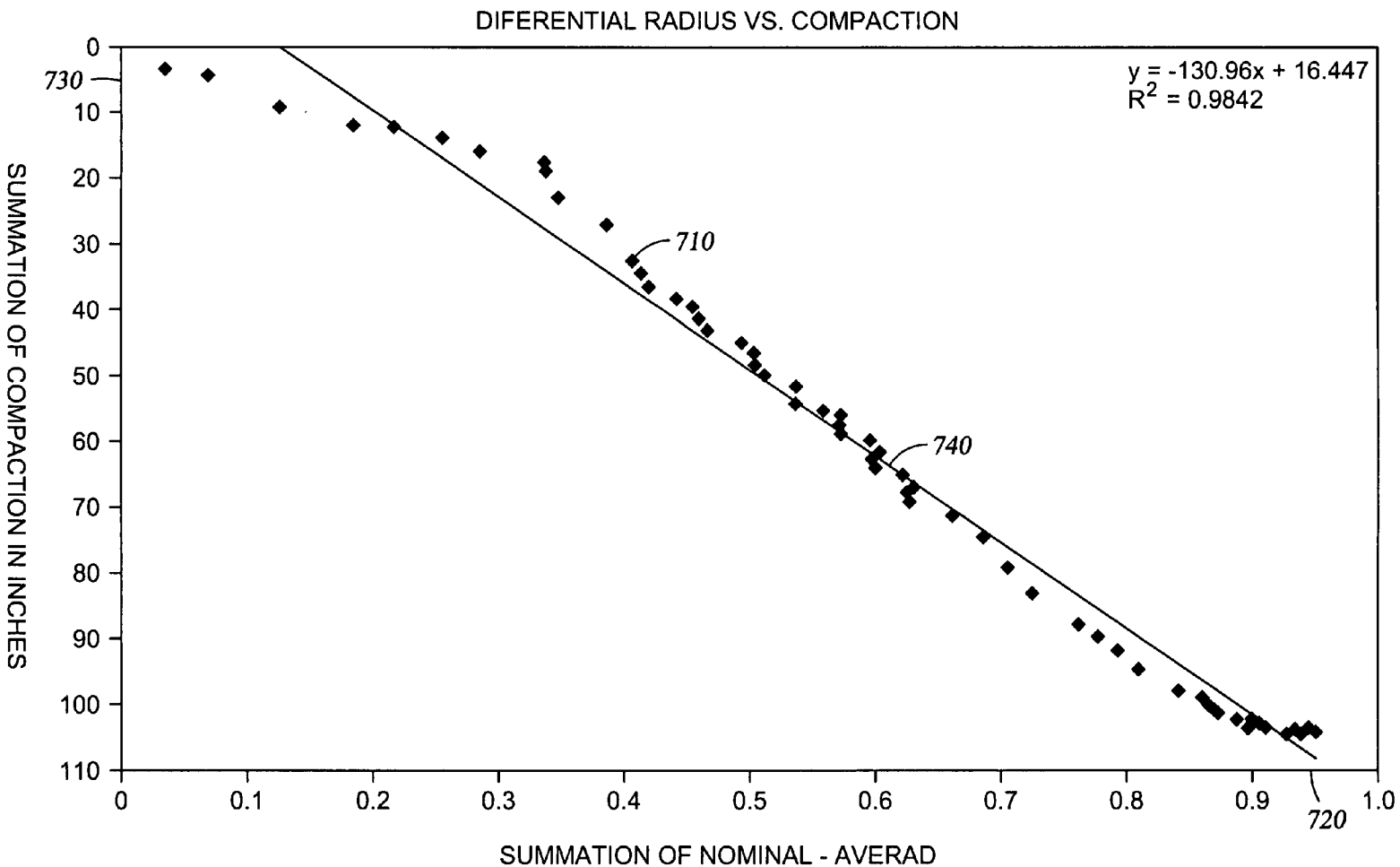
FIG. 7 is a graphical representation of the relationship of differential radius and compaction.

FIG. 7 illustrates the relationship between differential radius of the casing and compaction within the formation. Data points 710 mark individual relationships between differential radius 720 and compaction 730, where the differential radius and compaction are summated along the depth of the well. Curve 740 illustrates a generally linear relationship between differential radius and compaction through a large portion of the wellbore.

Figure 9:
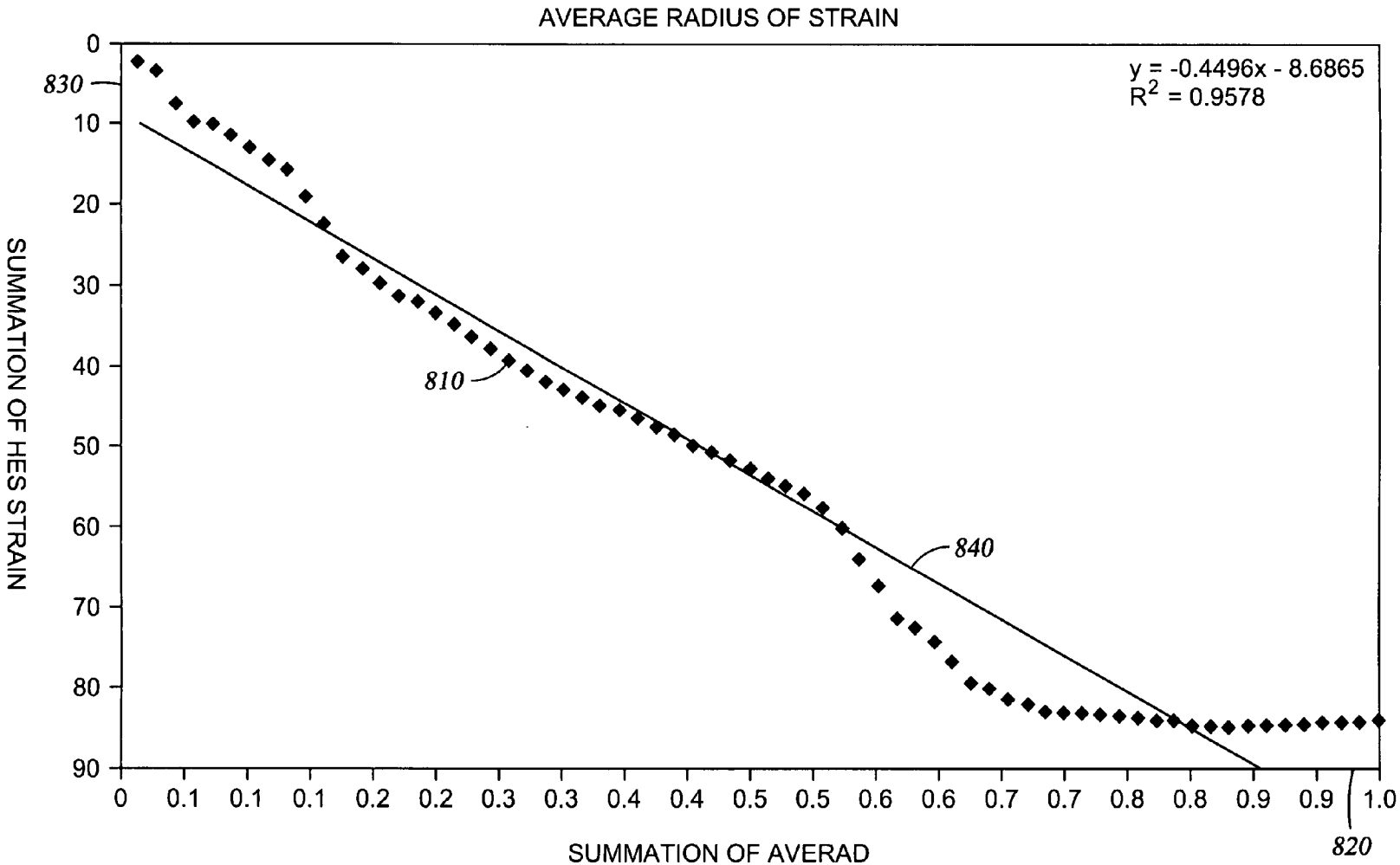
FIG. 9 is a graphical representation of the relationship of differential radius and strain.

FIG. 9 illustrates the relationship between average radius of the casing and strain. Data points 810 mark individual relationships between average radius 820 and strain 830, where the average radius and strain are summated along the depth of the well. Curve 840 illustrates a generally linear relationship between average radius and strain through a large portion of the wellbore.

Figure 8:
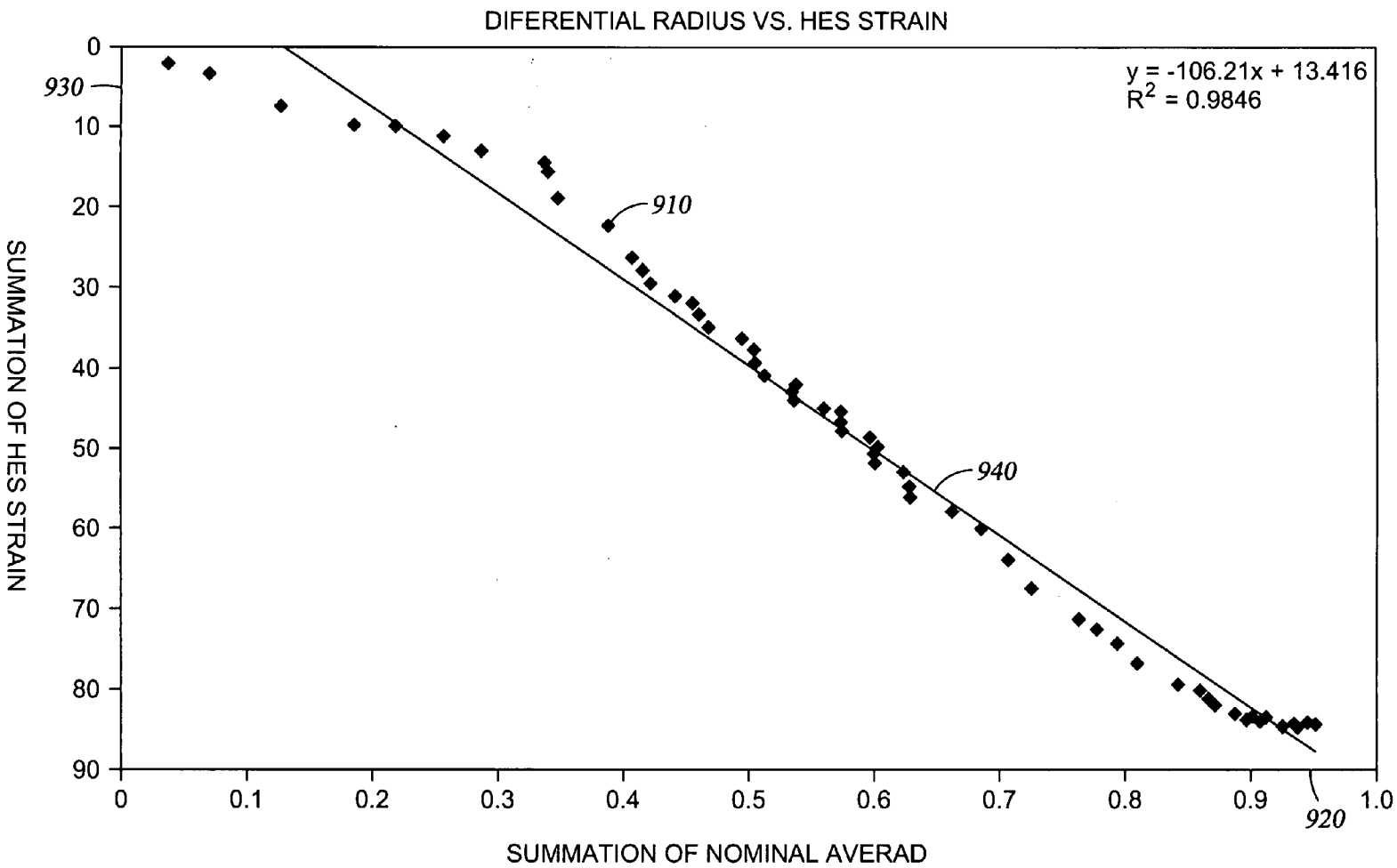
FIG. 8 is a graphical representation of the relationship of average radius and strain.

FIG. 8 illustrates the relationship between differential radius of the casing and strain. Data points 910 mark individual relationships between differential radius 920 and strain 930, where the differential radius and strain are summated along the depth of the well. Curve 940 illustrates a generally linear relationship between differential radius and strain through a large portion of the wellbore.

Certain embodiments may provide measurement and analysis for reservoir dynamic rock property modeling, either separate from or in coordination with the prior art methods. This modeling could be used to predict the 1) sanding potential of a reservoir over time with pressure decline and associated formation compaction, 2) mechanical failure of the well construction within a reservoir over time with pressure decline and associated formation compaction, 3) dynamic geomechanical analysis and dynamic well path placement design, 4) buckling failure of the well casing within a reservoir over time with formation compaction, 5) visualization of the casing damage due to compaction, and 6) near wellbore environment within a reservoir over time with formation compaction.

Select embodiments may provide for multiple transducer downhole tool designs measuring casing properties in an array form in order to enhance detectable casing properties, including but not limited to earth formation compaction. Other embodiments may provide for refracted waveform analysis based on processing of the acquired waveforms during monitor surveillance runs referencing, or combined with, baseline acquisitions. Still other embodiments may provide for ACE™ processed results during monitor surveillance runs referencing, or combined with, baseline acquisitions. Some embodiments may provide for cross dipole, oriented rotating refracted, and oriented rotating flexural sonic oriented receiver responses in the spirit of reservoir dynamic anisotropy and effects on same from the forces of formation compaction.

Certain embodiments may provide for oriented rotating nuclear tool responses, including but not limited to silicon yields, iron yields, natural gamma ray detection, spectral gamma ray detection, and the dynamic physical properties caused by exposure to earth formation compaction. For these embodiments, sigma can be derived from spectral analysis of pulsed neutron devices and the dynamic physical properties caused by exposure to earth formation compaction. One potential application would be multiple radioactive isotopes place within the earth formation and on the casing to measure each dynamic movement system over a period of time in a surveillance program.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A method for determining formation characteristics comprising:

establishing baseline casing conditions for a string of casing disposed within a wellbore in a formation;

measuring updated casing conditions for the string of casing at a first time interval from the establishing of the baseline casing conditions;

comparing the baseline casing conditions to the updated casing conditions to determine changes in the string of casing over the first time interval;

determining formation characteristics by applying an established correlation between the formation characteristics and changes in the casing conditions; and regulating at least one of production from the wellbore, a drilling parameter, or an earth model parameter in response to the determined formation characteristics.

2. The method of claim 1 wherein the baseline and updated casing conditions comprise geometric data taken from a plurality of depths within the string of casing.

3. The method of claim 2 wherein the geometric data comprises one or more of diameter, thickness, and eccentricity at a single depth within the string of casing.

4. The method of claim 1 wherein the formation characteristics comprise one or more of compaction, strain, failure prediction, and permeability.

5. The method of claim 1 further comprising adjusting reservoir management in response to the determined formation characteristics.

6. The method of claim 1 wherein the casing conditions are measured by acquiring ultrasonic data.

7. The method of claim 6 wherein the ultrasonic data includes two-way travel time and amplitude of first arrival of an ultrasonic signal.

8. The method of claim 1, wherein the correlation is established by comparing compaction logs to geometric properties of a portion of a cased wellbore that has markers locatable by a compaction logging tool.

9. A method for determining formation compaction comprising:

disposing an ultrasonic tool within a cased wellbore disposed within a formation;

performing an ultrasonic evaluation of the casing at a plurality of depths within the wellbore, wherein the ultrasonic evaluation produces an ultrasonic waveform response;

using the ultrasonic waveform response to determine geometric properties of the casing;

determining formation compaction by applying an established correlation between measured formation compaction and measured geometric properties of the casing, Tiw wherein performing the ultrasonic evaluation further comprises:

transmitting a signal from the ultrasonic tool toward the formation;

receiving the signal from the formation;

monitoring an amplitude of first arrival and a two-way travel time of the signal to and from the formation;

determining a thickness of the casing using the amplitude of first arrival; and determining a diameter of the cased wellbore using the two way travel time.

10. The method of claim 9 wherein performing the ultrasonic evaluation further comprises:

determining the relationship between the center of the ultrasonic tool and the center of the casing; and determining a corrected radius by adjusting for the relationship between the center of the ultrasonic tool and the center of the casing.

11. The method of claim 9 wherein performing the ultrasonic evaluation further comprises:

determining a casing diameter from the corrected radius;

calculating a cross-sectional casing area from the corrected radius; and determining formation compaction from the cross-sectional casing area.

12. The method of claim 9 further comprising using the geometric properties of the casing to determine formation strain.

13. The method of claim 9 further comprising using the geometric properties of the casing to determine formation permeability.

14. The method of claim 9 further comprising using the geometric properties of the casing to predict failure of the wellbore.

15. The method of claim 9 further comprising adjusting reservoir management in response to the formation compaction.

16. The method of claim 9, wherein the correlation is established by comparing compaction logs to geometric properties of a portion of a cased wellbore that has markers locatable by a compaction logging tool.

17. The method of claim 16 wherein the portion of the cased wellbore that has markers is a reference well drilled in a separate location.

18. A method for determining formation compaction comprising:

establishing baseline values for a geometric property of a casing string disposed within a wellbore drilled in a formation, wherein the baseline values are determined at a plurality of depths in the wellbore;

determining updated values for the geometric property at a plurality of depths in the wellbore;

comparing the updated values to the baseline values to determine changes in the one or more geometric properties;

determining formation compaction based on an established correlation between formation compaction and changes in the geometric property; and regulating at least one of production from the wellbore, a drilling parameter, or an earth model parameter in response to the determined formation compaction.

19. The method of claim 18 wherein the correlation is established by comparing compaction logs to geometric properties of a portion of a cased wellbore that has markers locatable by a compaction logging tool.

20. The method of claim 19 wherein the portion of the cased wellbore that has markers is a reference well drilled in a separate location in the formation.

21. The method of claim 18 wherein the baseline values are determined by inspection logs performed prior to the updated values being determined.

22. The method of claim 18 wherein the baseline values are determined by casing data acquired before the casing is installed in the wellbore.

23. The method of claim 22 wherein the baseline values are determined by adjusting the casing data for in-situ effects from the formation.

24. The method of claim 18 further comprising monitoring production from the wellbore in the time period prior to determining the updated values of the geometric property.

25. The method of claim 18 further comprising adjusting production from other wells in the formation in response to determined formation compaction.

26. A method for determining formation characteristics comprising:

establishing baseline casing conditions for a string of casing disposed within a wellbore in a formation;

measuring updated casing conditions for the string of casing at a first time interval from the establishing of the baseline casing conditions;

comparing the baseline casing conditions to the updated casing conditions to determine changes in the string of casing over the first time interval;

determining formation characteristics by applying an established correlation between the formation characteristics and changes in the casing conditions, wherein the correlation is established by comparing compaction logs to geometric properties of a portion of a cased wellbore that has markers locatable by a compaction logging tool, and wherein the portion of the cased wellbore that has markers is a reference well drilled in a separate location; and regulating at least one of production from the wellbore, a drilling parameter, or an earth model pammeter in response to the determined formation characteristics.

* * * * *